US005939135A

United States Patent [19]

Wu

[11] Patent Number: 5,939,135

[45] Date of Patent: Aug. 17, 1999

[54] GENERAL TYPE PRESS FORMING KNIFE-MOULD MADE OF PLAIN, SOFT AND THIN MATERIAL

[76] Inventor: Ming-Te Wu, 3F, No. 1 Yung-Fu St., San-Chung City ,Taipei, Taiwan

[21] Appl. No.: 09/098,246

[22] Filed: Jun. 17, 1998

[51] Int. Cl.[6] ..... B05D 3/10

[52] U.S. Cl. ..... 427/135; 427/133; 427/290; 427/305

[58] Field of Search ..... 427/133, 135, 427/305, 290

[56] References Cited

U.S. PATENT DOCUMENTS 4,404,232 9/1983 Evertz ..... 427/135

*Primary Examiner*—Janyce Bell

*Attorney, Agent, or Firm*—Pro-Techtor International Services

[57] ABSTRACT

A method of manufacturing a general type press forming knife-mould made of plain, soft and thin material, being comprised of selecting a medium, low carbon steel plate as a base whereon a knife edge having a desired contour is formed by shaping milling, then the knife edge or the knife edge together with the milled base being placed into a plating tank for hard chromium plating to increase hardness of the knife edge to Rockwell hardness 70 degrees; thereby, cost for material selection and cost of production of the knife-mould can be lowered, the life of use of the knife-mould can be prolonged, and the knife-mould can get a rust-proof effect by the method and is suitable for press forming of plain papers, card boards or plastic plates etc. on a knife-mould mounting machine.

1 Claim, 2 Drawing Sheets

GENERAL TYPE PRESS FORMING KNIFE-MOULD MADE OF PLAIN, SOFT AND THIN MATERIAL

BACKGROUND OF THE INVENTION

1. Field of the Invention

The present invention is related to a method of manufacturing a general type press forming knife-mould made of plain, soft and thin material, and especially to a press forming knife-mould used for press cutting plain papers, card boards or plastic plates etc. into complicated contours in cut-forming patterns, wherein, a unique knife-mould manufacturing method has been designed for increasing convenience of processing in manufacturing the knife-mould and prolonging life of use thereof, and cost for material selection as well as production of the knife-mould can be lowered, and even more, the knife-mould can get a rust-proof effect by the method.

2. Description of the Prior Art

The so called plain, soft and thin material used in the present invention is directed especially to common thinner papers, card boards or plastic plates etc. Cut forming of the plain, soft and thin material in the markets shall use a knife-mould having a desired contour being cut out to practise processing of press forming on the soft and thin material. However, when in manufacturing such a press forming knife-mould in the markets, the methods used having their disadvantages are divided into the following kinds:

The first kind: an engaging slitted seam is formed on a wood waste board or engineering plastic plate having a desired contour of the trace of the knife-mould by a laser or belt saw cutting method, then a manpower or mechanical bending method is practised on the spring like knife to engage it into the engaging slitted seam to thereby form the knife-mould with the desired contour.

The second kind: a spring steel plate is bent and welded to a frame or the surface of a mould, after forming of a desired knife-mould trace, the raised spring steel plate is ground to form the edge of a knife, thus the knife-mould with the desired contour is formed on a surface of the mould.

The knife-mould made by the above mentioned two methods are both produced with harder and bendable spring steel to get their bent knife edges with a hardness meeting the required standard, however, the flexibility in bending of the spring knives is extremely limited, it is therefore very difficult to process them into knife-molds with a finer and complicated trace and contour; the knife-moulds are made by engagement and thereby are less accurate, besides, the spring knife-moulds themselves are subjected to rusting, and therefore the life of use of them is shortended.

The third kind: an electricity discharging process is used to directly produce a knife-mould with a desired contour on a steel mould for punching. Such mode of production of the knife-mould can have higher accuracy, nevertheless, cost of production thereof is very high, and speed of the electricity discharging process is small, it has the disadvantage of being subjected to rusting as well.

The fourth kind: a light sensitive etching process is used to produce a knife-mould with a desired contour. In this method, a light sensitive film must be used to cover a very fine and small knife edge to be shaped in order to complete the knife edge with desired accuracy by etching, the light sensitive film which must be used to cover the fine and small knife edge is much subjected to dropping though, thereby difficulty and rate of fault thereof is very large, and the depth etched is very limited, so that it is difficult to produce a knife-mould with a higher knife edge, and thereby this method is not appropriate for press forming a knife-mould specific for a thicker card board.

The fifth kind: a three-dimensional milling process is directly applied on a metallic roller to produce a knife-mould with a desired contour on the roller. The method suits processing a knife-mould with a complicated figure, however, the roller of the knife-mould is made of steel and thus is subjected to rusting, and the knife-mould has to be used on a specific rotating roller, so that cost of production thereof is very high.

The sixth kind: a milling machine is used to directly shape by milling a knife-mould with a knife edge of a desired contour on a steel plate or a spring steel plate, and then partially heat treat the knife edge to complete the knife-mould with a desired knife edge hardness. The knife edge made by this method is subjected to rusting too, the fine knife edge shall be heat treated, difficulty in processing it is very high, and the process is extremely time consuming, it is practised with a milling machine directly on the harder steel plate or spring steel plate to shape the knife edge, when the knife-mould contour is complicated and fine, the milling cutter tends to be broken, and thereby increases damage of the knife.

The bottle-neck in improving the above stated press forming of a knife-mould to make the life of use of it longer, to make it uneasy to rust and have higher accuracy and production capability, and to make it suit mounting of various rotating or pressing machines in the markets, and thereby to make it substitution for a specific press forming machine of high price, is exactly the motive of the present invention.

SUMMARY OF THE INVENTION

The primary object of the present invention is to select a softer and more easily processed knife-mould base for forming by milling thereon a desired knife edge, then the knife edge is, or the knife edge together with the base, are processed by hard chromium plating to increase the hardness of the knife edge or the knife edge together with the base to Rockwell hardness 70 degrees, and thereby increases the hardness of the knife-mould and the effect of rust proofing.

Another object of the present invention is to make a knife-mould base from a medium, low carbon steel plate, in order to facilitate milling by a milling machine.

Another object of the present invention is to mount the knife-mould processed by the hard chromium plating on a rotary roller machine, or on a mould plate of any of various reciprocating punching machines, to thereby reduce the cost for manufacturing a specific press forming equipment.

The present invention will be apparent after reading the detailed description of the preferred embodiment thereof in reference to the accompanying drawings.

DETAILED DESCRIPTION OF THE PREFERRED EMBODIMENT

Figure 1:
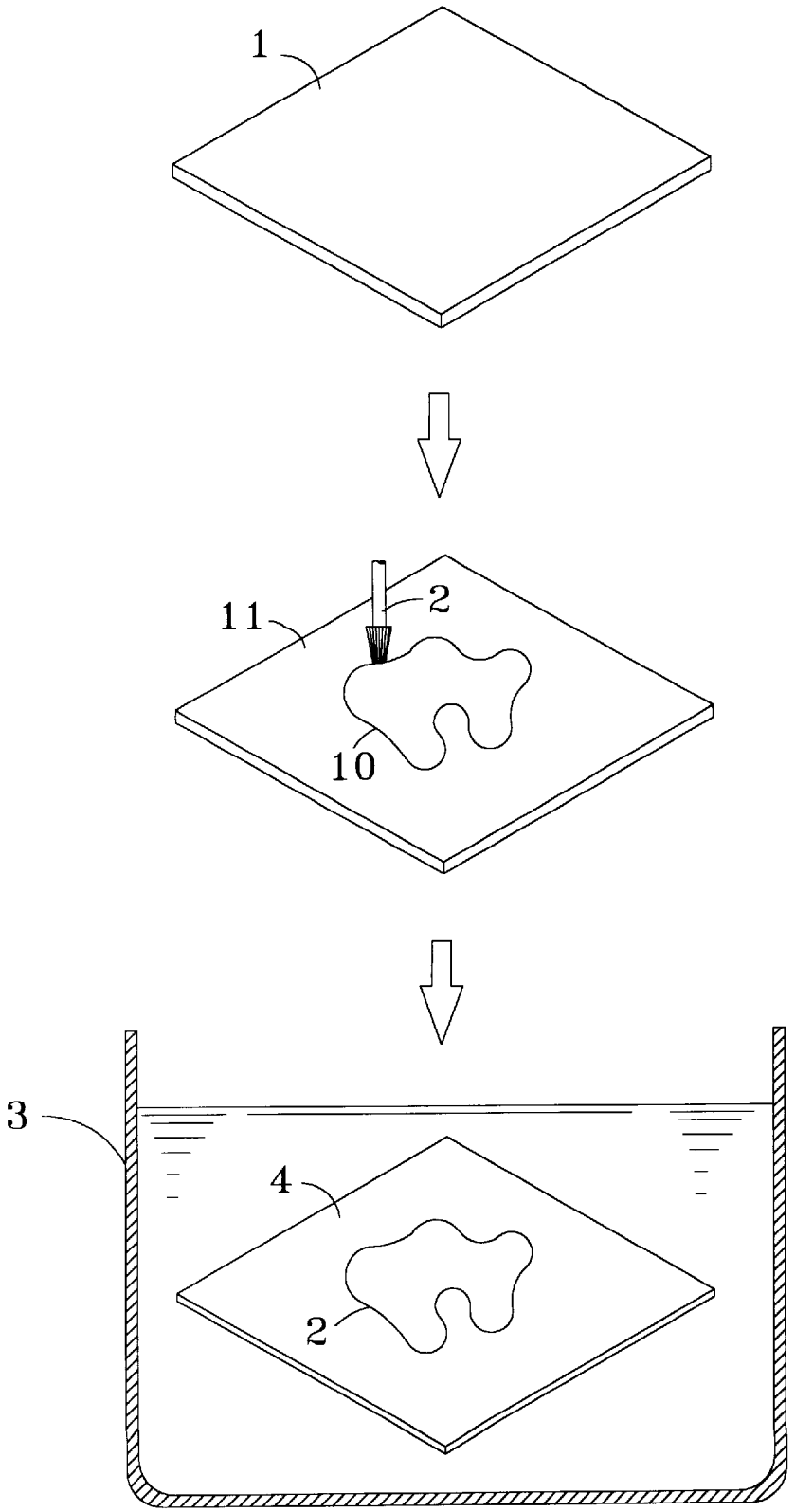
FIG. 1 is a process flow chart of the present invention.
Figure 2:
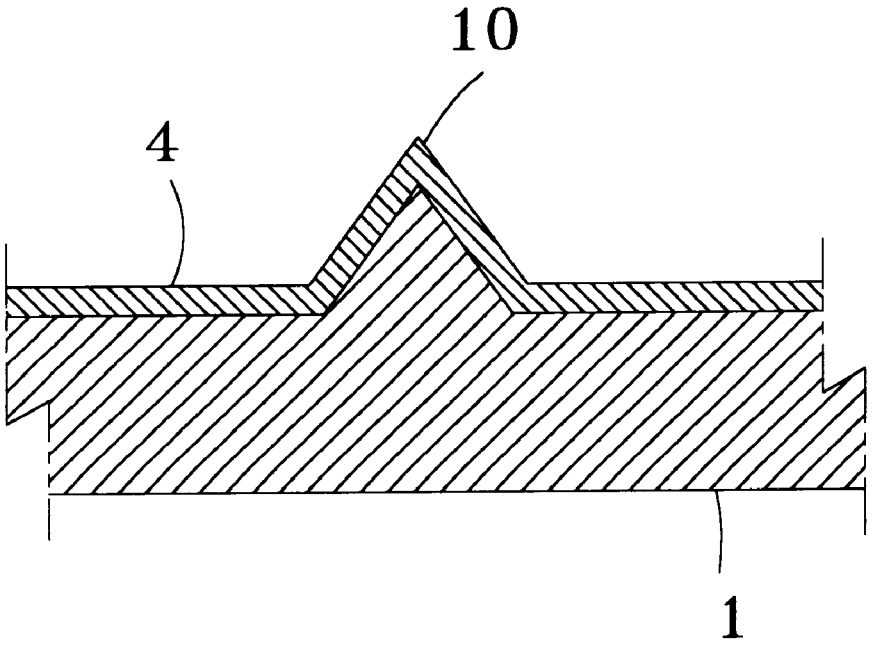
FIG. 2 is a partial sectional view of the knife-mould of the present invention.

Referring to FIG. 1 in the first place, the present invention provides a method of manufacturing a general type press forming knife-mould made of plain, soft and thin material, wherein principally, a medium, low carbon steel plate is selected as a base 1, whereon, a knife edge 10 having a desired contour is formed by a shaping milling machine 2, then the knife edge 10 is, or the knife edge 10 together with the milled base surface 11 of the base 1 are, placed into a plating tank 3 for hard chromium plating, a layer of hard chromium 4 is formed thereby on the knife edge 10 (as shown in FIG. 2) and the hardness of the knife edge 10 is increased to Rockwell hardness 70 degrees.

The knife-mould made by the above process, by virtue that it uses the medium, low carbon steel plate as the base 1 which is easier for processing, is provided with easier workability of accurate automatic milling by means of the shaping milling machine 2, especially when in milling at the areas or turns with more complicated bending contours, the shaping milling machine 2 is not subjected to damage, therefore, speed and effect of production is excellent.

The knife edge 10 of the knife-mould made by the above process is harder and more durable and is uneasy to rust by virtue that the layer of hard chromium 4 is provided thereon.

The knife-mould made by the above process surely can be used on a rotary roller cutter or a reciprocating punching machine to largely reduce cost of production of a press forming machine.

In conclusion, the method of manufacturing a general type press forming knife-mould made of plain, soft and thin material provided by the present invention can certainly meet the requirement of high accuracy and a complicated figure under the condition of reducing cost of the equipment and of the production of the knife-mould, it is industrially competitive and practical and distinctly improved upon the conventional methods.

Having thus described my invention, what I claim as new and desire to be secured by Letters Patent of the United States is:

1. A method of manufacturing a a mold for a press forming machine comprising the steps of:

(a) selecting a carbon steel plate as a base, (b) forming a knife edge having a desired contour is formed by milling said base, (c) placing said knife edge formed on said milled base into a plating tank where said knife edge on said milled base is subjected to a hard chromium plating process to increase a hardness of said knife edge to Rockwell hardness 70 degrees such that said knife edge is suitable for use as a mold in a press forming machine to stamp a desired pattern from a stock material.

* * * * *